US006722221B2

(12) United States Patent
Maxwell

(10) Patent No.: US 6,722,221 B2
(45) Date of Patent: Apr. 20, 2004

(54) ADJUSTABLE CAM SHAFT SPROCKET

(76) Inventor: Steven Frank Maxwell, 8494 Commerce Ave., San Diego, CA (US) 92121

( * ) Notice: Subject to any disclaimer, the term of this patent is extended or adjusted under 35 U.S.C. 154(b) by 0 days.

(21) Appl. No.: 10/061,028

(22) Filed: Feb. 1, 2002

(65) Prior Publication Data

US 2003/0148839 A1 Aug. 7, 2003

(51) Int. Cl.[7] ..... F16H 35/08
(52) U.S. Cl. ..... 74/395; 74/568 R; 474/902
(58) Field of Search ..... 474/152, 94, 902, 474/96, 95, 45; 74/411, 395, 443, 447; 123/90.17, 90.15; 29/407.05

(56) References Cited

U.S. PATENT DOCUMENTS

| | | | | | |
|---|---|---|---|---|---|
| 379,022 | A | * | 3/1888 | Morgan | 74/443 |
| 781,219 | A | * | 1/1905 | Mills | 74/395 |
| 3,711,929 | A | * | 1/1973 | Blakey et al. | 29/407.05 |
| 3,734,073 | A | * | 5/1973 | Walter et al. | 74/395 |
| 3,789,687 | A | * | 2/1974 | Cutter | 474/902 |
| 5,174,169 | A | * | 12/1992 | Allen | 74/395 |
| 5,833,562 | A | * | 11/1998 | Walker, Sr. | 474/96 |
| D454,896 | S | * | 3/2002 | Koch | D15/148 |
| 6,532,923 | B2 | * | 3/2003 | Woodward et al. | 123/90.17 |

FOREIGN PATENT DOCUMENTS

| | | | | |
|---|---|---|---|---|
| DE | 3313733 A1 | * | 10/1984 | F02D/1/16 |
| JP | 10-164714 A | * | 6/1998 | H02B/13/02 |

* cited by examiner

*Primary Examiner*—Marcus Charles

(57) ABSTRACT

An adjustable cam shaft sprocket for allowing small adjustments to a cam shaft. The adjustable cam shaft sprocket comprises an inner member and an outer member, the inner member being placed concentrically within the first circular member and held in place by a fastener. A series of openings located at the perimeter of the inner member and outer member are arranged such that only one pair of openings between the inner member and the outer member are aligned for each hole alignment. A shear pin is inserted through the aligned pair of openings to prevent the inner member from rotating with respect to the outer member. A small adjustment to the cam shaft is achieved by removing the shear pin, rotating the inner member with respect to the outer member so that a second pair of openings is aligned, and re-inserting the shear pin.

16 Claims, 8 Drawing Sheets

ADJUSTABLE CAM SHAFT SPROCKET

SCOPE

The present invention relates to internal combustion engines. More specifically, the present invention relates to an adjustable cam shaft sprocket for allowing small adjustments to a camshaft.

BACKGROUND

As is well known, for a four-cycle internal combustion engine to run smoothly, the rotation of the crankshaft and the camshaft must remain in synchronization. Should they fall out of synchronization, serious damage can occur to the engine. Furthermore, it is well known that the maximum horsepower from an engine can be achieved by adjusting the camshaft so that the cams open and close the various engine valves at precisely the right times, thereby improving pumping efficiency.

Generally, in internal combustion engines, a timing chain, belt, or gear is installed around a crank shaft gear, or cam shaft sprocket, mounted on one end of the crank shaft. The timing chain is also installed around a crank shaft gear, which is mounted on one end of a crank shaft. The timing chain thus transfers rotational energy from the crank shaft to the cam shaft sprocket and, hence, the cam shaft. This serves the purpose of not only causing the cam shaft to rotate, but it also maintains the rotational synchronization of these two shafts.

Generally, an engine will operate efficiently within given operating tolerances when the timing chain is installed so that a proper relationship to the drive shaft is achieved. A course adjustment of the cam shaft, and thus, the cams themselves, can be achieved by adjusting the timing chain on the cam shaft gear plus or minus one link in the timing chain. However, this allows only a course adjustment to the cam shaft.

To achieve maximum engine performance, the cam shaft may be further adjusted with respect to the crank shaft by using an adjustable cam shaft sprocket. As shown in FIG. 1*a*, an adjustable cam shaft sprocket comprises an inner member and an outer member. The inner member is installed concentrically within the outer member, the outer member being toothed for engaging the timing chain. The inner member and the outer member are fastened together using one or more bolts. A fine adjustment of the cam shaft sprocket can be achieved by loosening the bolts, thereby allowing the outer member to be adjusted by any amount with respect to the inner member. When the desired amount of adjustment is achieved, the bolts are tightened so that the inner member and the outer member do not rotate with respect to each other.

One problem with using an adjustable cam shaft sprocket as described above is that over time, the inner member can rotate with respect to the outer member, either by a small amount or a large amount. If the members rotate a small amount with respect to each other, engine performance will suffer. If the members rotate a large amount with respect to each other, a gross misalignment of the cam shaft with respect to the crank shaft will occur, and severe engine damage may result. Rotation between the members occurs because the bolts do not prevent the members from moving with respect to each other. The members are held together by the frictional force between the members that result when the bolts are tightened.

Another method of adjusting a cam shaft is by using a device as shown in FIG. 1*b*. This device is bolted directly onto the end of a cam shaft and a timing belt or chain is installed around the teeth on the perimeter of the device. The cam shaft has openings which align with one or more holes in the device. When the cam shaft is in the desired position, it is hoped that one of the holes on the device will be aligned with one of the cam shaft openings. If so, then a shear pin is inserted through the aligned openings, and a bolt is tightened to keep the device secured to the end of the cam shaft. If a pair of openings does not align, the belt or chain must be removed and the device repositioned and the hole alignment must be performed again. Even when an initial alignment between openings is achieved, the relative position of the cam shaft with respect to the drive shaft may change slightly due to various factors, such as stretching in the timing belt or chain, and the alignment procedure must be done again. Thus, achieving the desired cam shaft alignment becomes a long, repetitive task.

What is needed is an adjustable cam shaft sprocket that will allow fine adjustments to the cam shaft while preventing rotation between the members with respect to each other during normal engine operation. Ideally, the adjustment would not require removal of the timing belt or timing chain, and would be accomplished in a relatively short period of time.

SUMMARY

The present invention is directed to an apparatus for allowing small adjustments to a cam shaft. In one embodiment, the present invention comprises a shear pin and a first circular member having a toothed outer surface for receiving a timing chain or belt, a first cam shaft opening, and a recessed planar surface having a first number of openings located proximate to a perimeter of the recessed planar surface. The present invention further includes a second circular member having a second planar surface and a cylindrical portion extending perpendicularly from the second planar surface, the second planar surface having a cam shaft opening extending through the cylindrical portion and a second number of openings located proximate to a perimeter of the second planar surface, the second circular member for being placed concentrically within said first circular member wherein the second circular member is prevented from rotating with respect to said first circular member by inserting the shear pin through one of the second number of openings and through one of the first number of openings, wherein the second circular member may be adjusted incrementally with respect to the first circular member by removing the shear pin and rotating the second circular member with respect to the first circular member such that a second one of the second number of openings is aligned with a second one of the first number of openings.

BRIEF DESCRIPTION OF THE DRAWINGS

The objects presented are best understood when viewed in accordance with the following description of the drawings:

FIGS. 4*a* and 4*b* illustrate an outer member of FIG. 2 in accordance with one embodiment, wherein FIG. 4*a* shows the outer member in a plan view and FIG. 4*b* shows the outer member in a side view;

FIGS. 5*a* and 5*b* illustrate an inner member of FIG. 2 in accordance with one embodiment, wherein FIG. 5*a* shows the inner member in a plan view and FIG. 5*b* shows the inner member in a side view;

FIGS. 9*a* and 9*b* illustrate the relationship between openings in the outer member of FIGS. 4*a* and 4*b* and openings in the inner member of FIGS. 5*a* and 5*b*, wherein FIG. 9*a* shows openings located on the outer member and FIG. 9*b* shows openings located on the inner member.

DETAILED DESCRIPTION

Figure 1A:
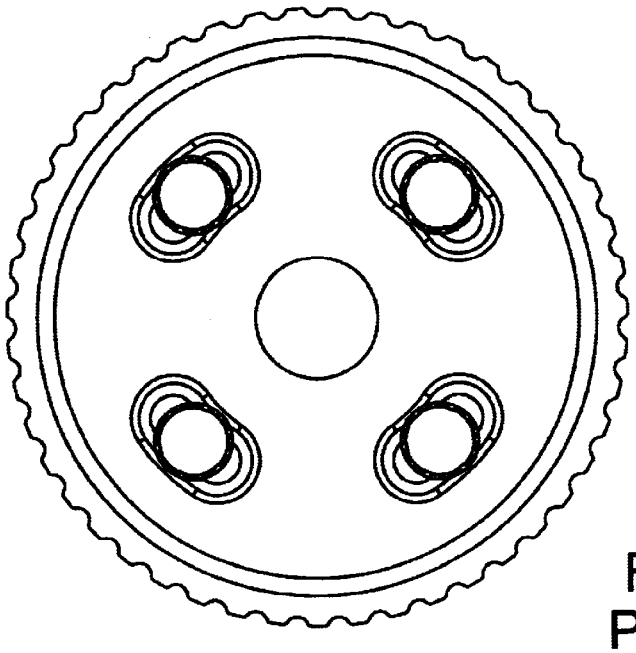
Fig. 1a Prior Art
FIGS. 1*a* and 1*b* illustrate prior art adjustable cam shaft sprockets.
Figure 1B:
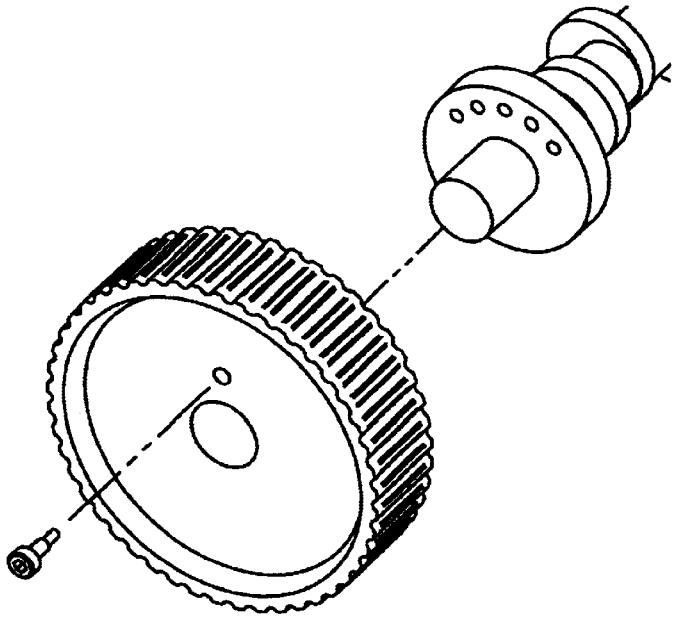
Fig. 1b Prior Art
Figure 2:
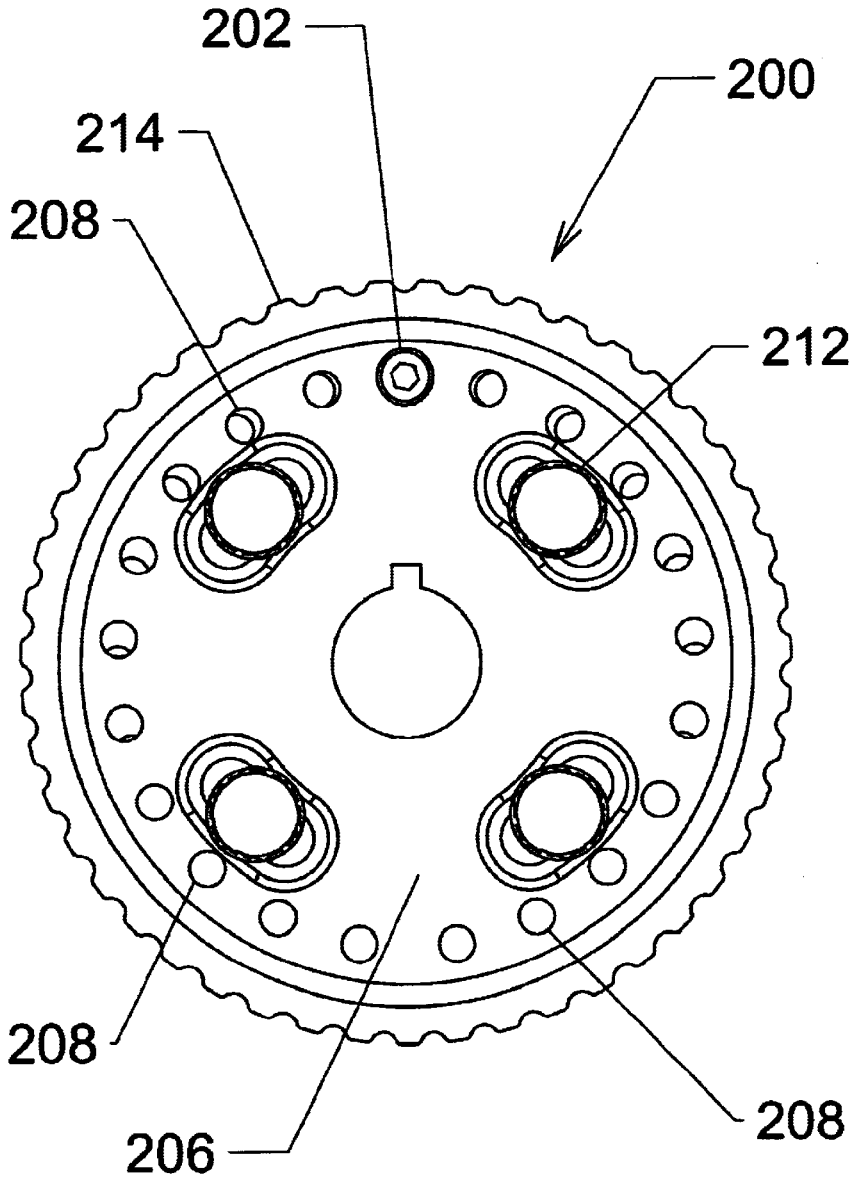
FIG. 2 illustrates an adjustable cam shaft sprocket in accordance with one embodiment.

FIG. 2 illustrates an adjustable cam shaft sprocket 200 in accordance with one embodiment. Adjustable cam shaft sprocket 200 comprises a shear pin 202, an outer member 204, and inner member 206. Inner member 206 is seating concentrically within outer member 204 and held in place by bolts 212. Although FIG. 2 shows four bolts 212, it should be understood that any number of bolts may be used to hold inner member 206 against outer member 204.

Shear pin 202, otherwise known as a shoulder bolt, is used to maintain alignment between inner member 206 and outer member 204. Shear pin 202 is placed through one of a number of openings 208 located on a planer surface of inner member 206 and also through one of a number of openings located on a planer surface of outer member 204. The relationship between the holes located on inner member 206 and outer member 204 determines the amount of adjustment between the members, and thus, the amount of adjustment which is applied to a cam shaft which is installed through cam shaft opening 210.

In one embodiment, inner member 206 measures approximately 3⅜ inches in diameter and is approximately 3/16 inches thick. Outer member 204 measures approximately 4 inches in diameter and is 1⅛ inches thick in the area of teeth 214. Outer member 204 comprises a planar surface which is recessed from teeth 214 by approximately ⅜ inches. A wall formed by the recessed planar surface of outer member 204 forms a diameter which is slightly larger than the diameter of inner member 206 so that inner member 206 may be placed concentrically within outer member 204. Both inner member 206 and outer member 204 comprise a rigid material, such as aluminum, steel, or any other material known by those skilled in the art for generally constructing such an adjustable cam shaft sprocket. Both inner member 206 and outer member 204 are manufactured by methods well known in the art.

Figure 3:
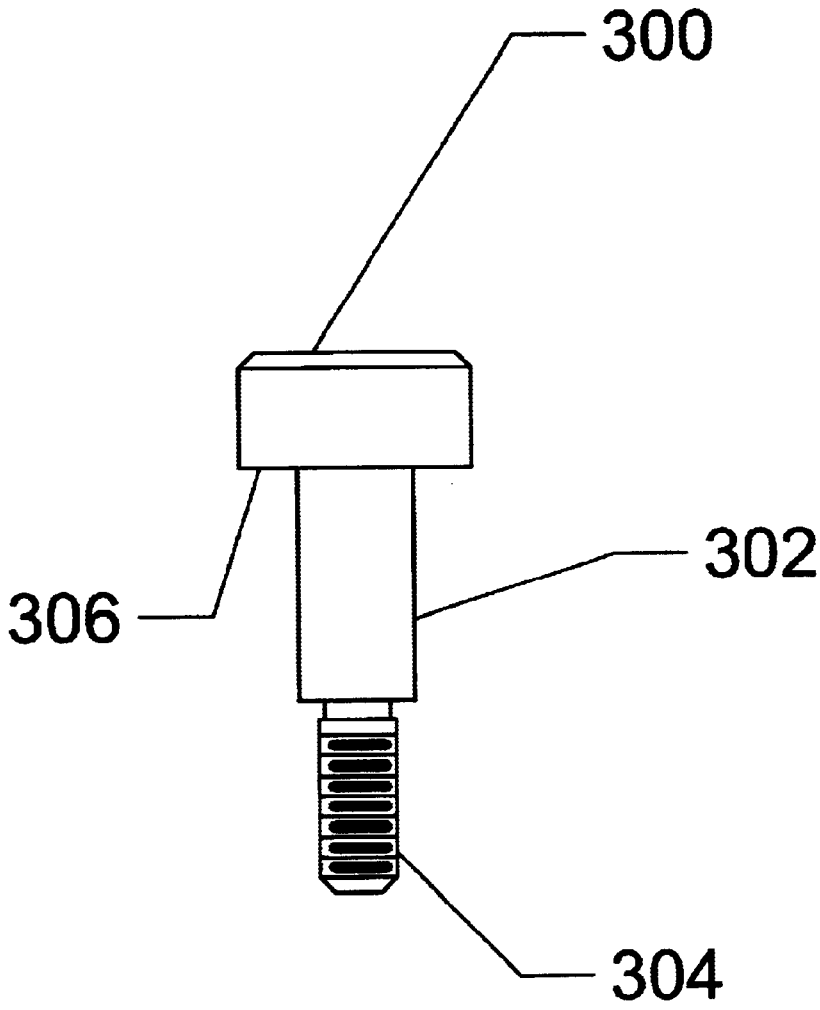
FIG. 3 illustrates a shear pin of FIG. 2 in accordance with one embodiment.

FIG. 3 illustrates shear pin 202 in accordance with one embodiment. Shear pin 202 comprises a head 300, a shaft 302, and a threaded end 304. In operation, threaded end 304 is inserted through one of a number of openings located on a planar surface of inner member 206 and screwed into one of a number of threaded openings located on a planar surface of outer member 204. Shear pin 202 is tightened into place generally by applying torque to head 300 using any number of devices, such as a socket wrench, Allen wrench, screwdriver, etc. Of course, for each of the just-named embodiments, head 300 is fashioned accordingly. For example, head 300 comprises a hexagonal shape for receiving a socket wrench or head 300 comprises a pan head with a slotted cutout for receiving a screwdriver. Head 300 also limits the amount of distance shear pin 202 will travel into the threaded opening of the outer member, as the undersurface 306 of head 300 rests directly on the planar surface of inner member 206 upon installation. Of course, a washer could be used in another embodiment in which case the washer would be situated between undersurface 306 and the planar surface of inner member 206.

When shear pin 202 is installed through the two members as explained above, shaft 302 prevents the members from rotating with respect to each other. If one member tries to rotate with respect to the other, a shear force is exerted on the surface of shaft 302, but as long as shear pin 202 is resilient enough to withstand such force, the members will not rotate with respect to one another. As such, shear pin 202 generally comprises some sort of metal or alloy, such as stainless steel, aluminum, etc., and is appropriately thick enough to withstand such force.

Shear pin 202 can alternatively comprise other shapes and features without departing from its use with adjustable cam shaft sprocket 200, i.e., aligning the two members to each other and preventing rotation therebetween. For example, as discussed above, head 300 might comprise different shapes to afford various types of tools, or, in another embodiment, head 300 may not be present at all. In this case, head 300 is simply an extension of shaft 302.

Figure 4A:
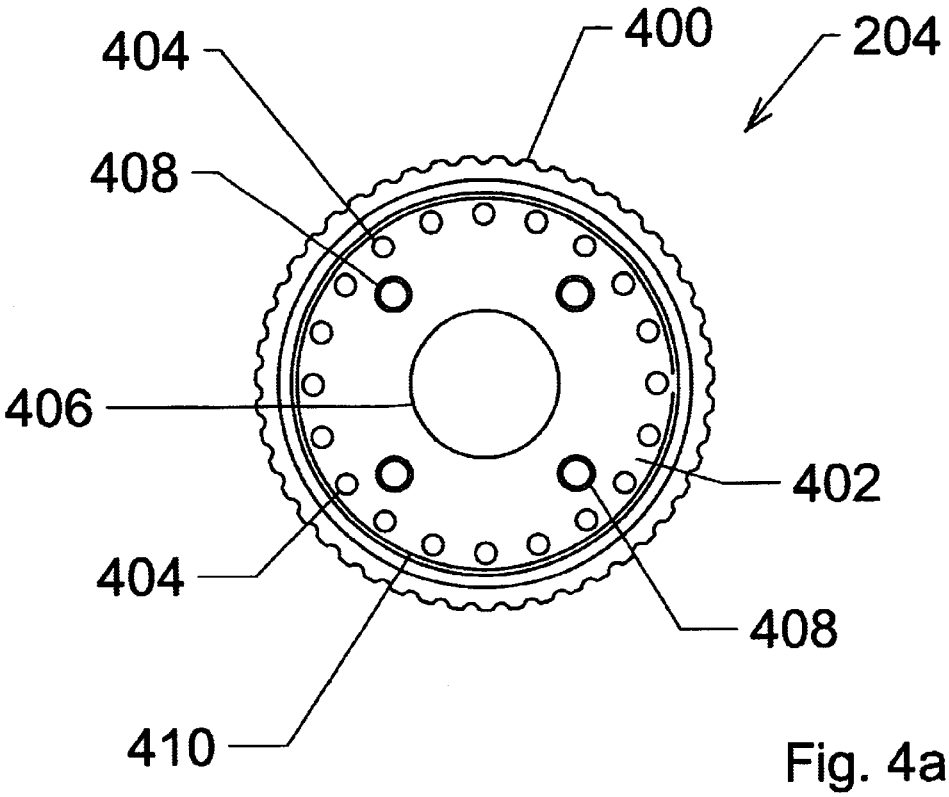
Figure 4B:
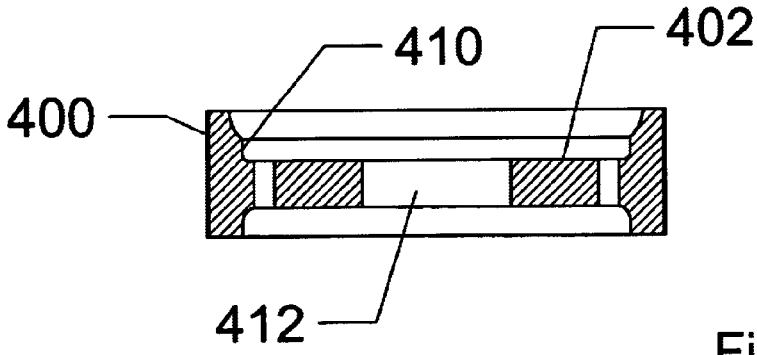

FIGS. 4*a* and 4*b* illustrate outer member 204 in accordance with one embodiment. FIG. 4*a* shows outer member 204 in a plan view while FIG. 4*b* shows outer member 204 in a side view. In FIG. 4*a*, outer member 204 comprises a circularly-shaped object having teeth 400 located on its perimeter. Teeth 400 are used to engage a timing chain (not shown) which is used to rotate the assembled adjustable cam sprocket 200. In one embodiment, outer member 204 comprises a diameter of six inches, however outer member 204 may alternatively be larger or smaller in diameter. Teeth 400 generally span the entire height of outer member 204, as shown in FIG. 4*b*, although in other embodiments, this may not be the case.

Outer member 204 also comprises a planar surface 402. Planar surface 402 comprises a number of openings 404 for receiving shear pin 202. In one embodiment, each of openings 404 comprises a threaded recess for securing shear pin 202 in place. The threaded recesses also serve to remove shear pin 202 when desired. In other embodiments, openings 404 may comprise through holes or recesses having fastening means inserted therein for securing shear pin 202 in place. The openings 404 are generally located near the periphery of planar surface 402, although in other embodiments, they may be located anywhere and, in general, maintain a circular shape with respect to one another. Outer member 204 as shown in FIG. 4*a* comprises twenty openings 404, however in other embodiments, a greater or fewer number of openings could be used. Planar surface 402 additionally comprises opening 406 for allowing a center portion of inner member 206 to pass upon assembly. Opening 406 may be of any desired shape, however it is generally circular in shape. Bolt openings 408 allow bolts 212 (shown in FIG. 2) to pass. Bolt openings 408, in one embodiment, are threaded. In another embodiment, oblong openings 408 are not threaded, allowing bolts 212 to pass, while a nut secures bolts 212 in place. Although FIG. 4*a* shows 4 bolt openings 408, it should be understood that a greater or fewer number of bolt openings may be used in other embodiments.

Figure 5A:
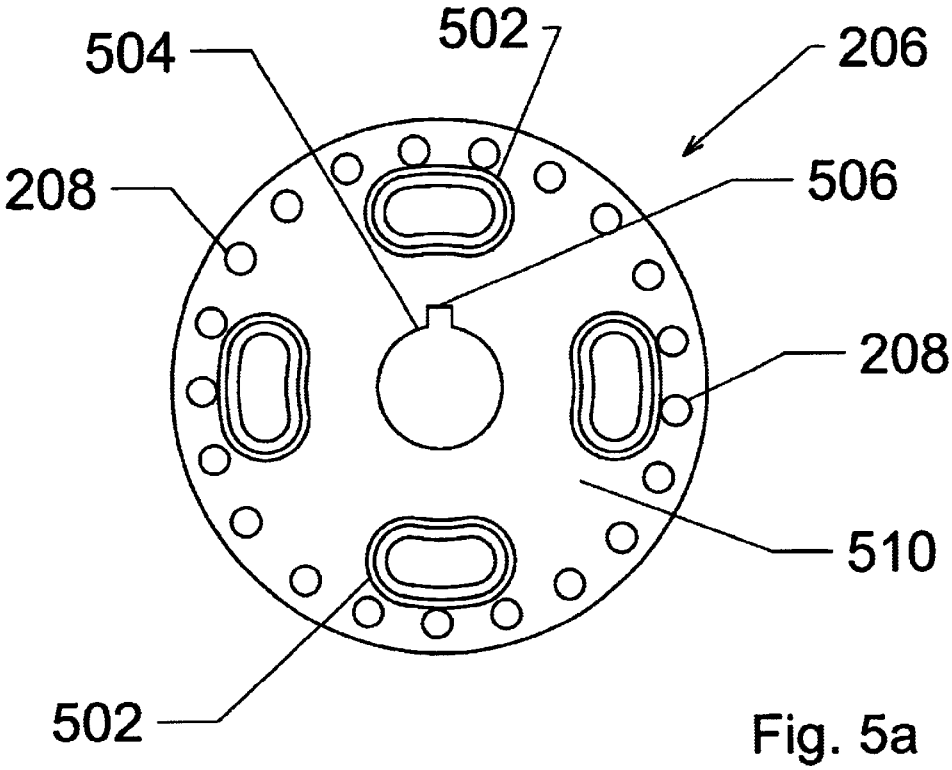
Figure 5B:
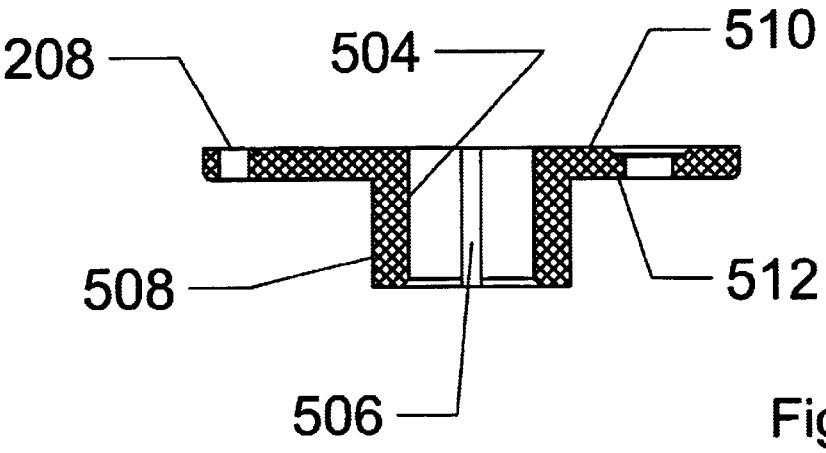

FIGS. 5*a* and 5*b* illustrate inner member 206 in accordance with one embodiment. FIG. 5*a* shows inner member 206 in a plan view while FIG. 5*b* shows inner member 206 in a side view. Inner member 206 is circular when viewed in plan view as shown. The diameter of inner member 206 is such that inner member 206 will fit within wall 410 of outer member 204. Inner member 206 additionally comprises oblong openings 502 for allowing bolts 212 to pass. The oblong openings 502 are generally oblong in nature to allow rotational, or angular, adjustment of inner member 206 within outer member 204 during use.

Inner member 206 additionally comprises a cam shaft opening 504, for allowing one end of a cam shaft to pass. Cam shaft opening 504 generally comprises a notch 506 which operates as a key for mounting the cam shaft through cam shaft opening 504 (the cam shaft generally comprises a raised extrusion which fits into cam shaft notch 506). The notch 506 also acts to connect the cam shaft to inner member 206 so that, during operation, as the timing chain turns outer member 204 and thus inner member 206, the cam shaft is rotated as the timing chain is moved by the crank shaft.

Inner member 206 additionally comprises a portion 508 which extends perpendicularly away from an under surface 512, located opposite to planar surface 510. As such, inner member 206 resembles a "T", as shown in FIG. 5*b*. The portion 508 is cylindrical in nature, and comprises a diameter which fits within a channel 412 of outer member 204. Portion 508 is not used in other embodiments.

Inner member 206 additionally comprises openings 208, as shown in FIG. 5*a*. Openings 208 each allow shear pin 202 to be inserted therethrough. In one embodiment, inner member 206 comprises twenty-one openings 208 located near an outer circumference of planar surface 510. It should be understood that any number of openings 208 could be used in an alternative embodiment. It should also be understood that the location of openings 208 may be located in another area of planar surface 510, although they will generally retain a circular relationship with each other.

Figure 6:
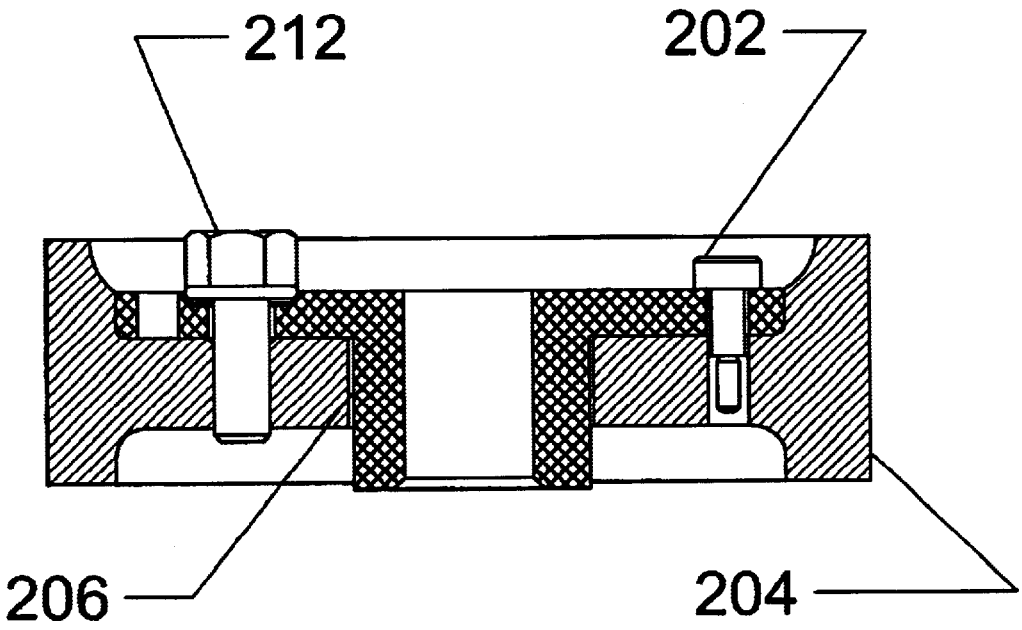
FIG. 6 illustrates a side view of the adjustable cam shaft sprocket of FIG. 2 in an assembled state, showing hidden surfaces which would normally not be seen.

FIG. 6 illustrates a side view of adjustable cam shaft sprocket 200 in an assembled state, showing hidden surfaces which would normally not be seen. Inner member 206 is positioned into outer member 204 by inserting portion 508 of inner member 206 through opening 406 of outer member 204. The diameter of wall 410 is slightly larger in diameter than the diameter of planar surface 510 of inner member 206, so that inner member 206 is free to rotate when it is inserted into outer member 204. One of the openings 208 of inner member 206 is aligned with one of the openings 404 of outer member 204, then shear pin 202 is inserted through both openings and secured in place. In one embodiment, shear pin 202 comprises a threaded end 304 which is screwed into opening 404, as described above.

Once shear pin 202 has been secured through the one of the openings 208 and 404, inner member 206 and outer member 204 are secured together using one or more bolts 212 (only one bolt 206 is shown if FIG. 6 for clarity). The assembly of adjustable cam shaft sprocket 200 is then complete. After assembly, adjustable cam shaft sprocket 200 is then installed onto one end of a cam shaft, then a timing belt or timing chain is used to engage teeth 400 with a gear mounted to a crank shaft. Of course, the cam shaft must be aligned with the crank shaft, and generally known techniques are used to ensure that this is so.

Once the cam shaft has been properly aligned with the crank shaft, a further refinement of this relationship can be achieved using adjustable cam shaft sprocket 200.

Inner member 206 can be rotationally adjusted in very small amounts with respect to outer member 204 as follows. The bolts 212 are loosened and shear pin 202 is removed so that inner member 206 and installed cam shaft can rotate with respect to outer member 204. Inner member 206 may then be rotated in very small increments in either a clockwise or counter-clockwise direction. As inner member 206 is rotated with respect to outer member 204, only one set of openings 208 and 404 will align, allowing shear pin 202 to be inserted therethrough. This concept is best illustrated in FIGS. 7 and 8 as follows.

Figure 7:
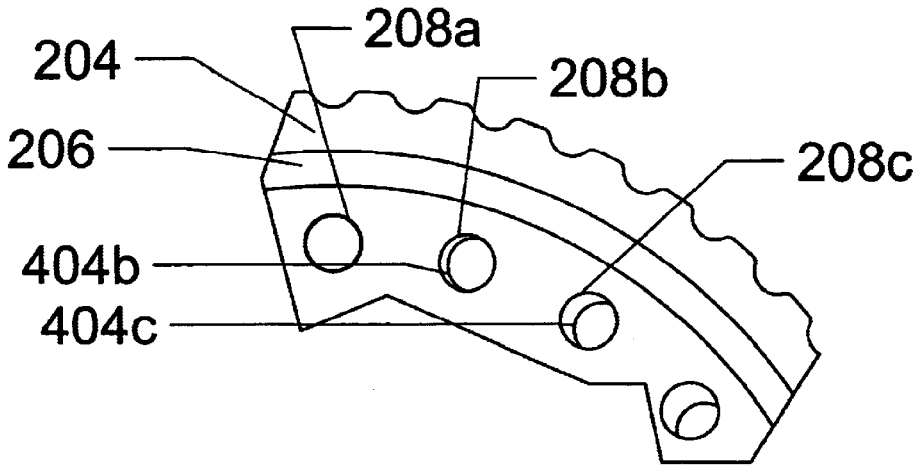
FIG. 7 illustrates a close-up view of one section of the inner member of FIGS. 5*a* and 5*b* assembled with the outer member of FIGS. 4*a* and 4*b;*

FIG. 7 illustrates a close-up view of one section of inner member 206 assembled with outer member 204. Various details of both inner member 206 and outer member 204 have been omitted so that the relationship between openings 208 and 404 can be shown.

As shown in FIG. 7, opening 208*a* is aligned with opening 404*a* such that shear pin 202 can be inserted through both openings without obstruction (opening 404*a* is not shown in FIG. 7 because of the alignment with opening 208*a*). When openings 208*a* and 404*a* are aligned, general no other openings will be aligned, although in other embodiments, it may be possible that more than one pair of openings may be aligned. This concept is illustrated in FIG. 7, with opening 208*b* having a small misalignment between it and opening 404*b*. Opening 208*c* is slightly more misaligned with opening 404*c* than opening 208*b* is with respect to opening 404*b*. Successive pairs of openings become more and more misaligned as one views the pairs in a clockwise direction from openings 208*a* and 404*a*.

Figure 8:
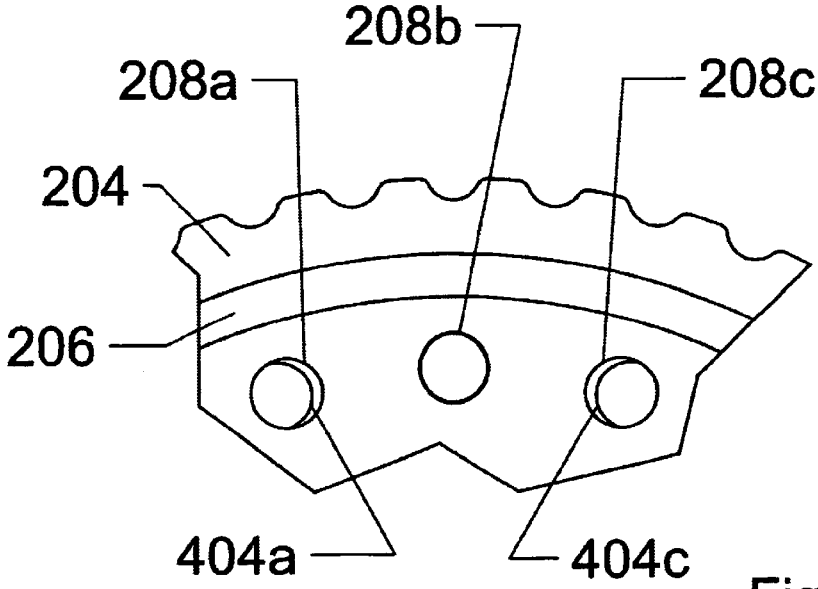
FIG. 8 illustrates another close-up view of the section shown in FIG. 7, showing a small clockwise adjustment of the inner member of FIGS. 5*a* and 5*b* with respect to the outer member of FIGS. 4*a* and 4*b* from the alignment shown in FIG. 7.

FIG. 8 illustrates another close-up view of the same section of inner member 206 and outer member 204. Again, various details of both inner member 206 and outer member 204 have been omitted so that the relationship between openings 208 and 404 can be shown.

FIG. 8 illustrates a small clockwise adjustment of inner member 206 with respect to outer member 204 from the alignment shown in FIG. 7. In this illustration, opening 208*b* is aligned with opening 404*b* such that shear pin 202 can be inserted through both openings without obstruction (opening 404*b* is not shown in FIG. 8 because of the alignment with opening 208*b*). When openings 208*b* and 404*b* are aligned, generally no other openings will be aligned. Again, this concept illustrates that opening 208*c* is slightly misaligned with opening 404*c*, while opening 208*a* is slightly misaligned with opening 404*a*.

Figure 9A:
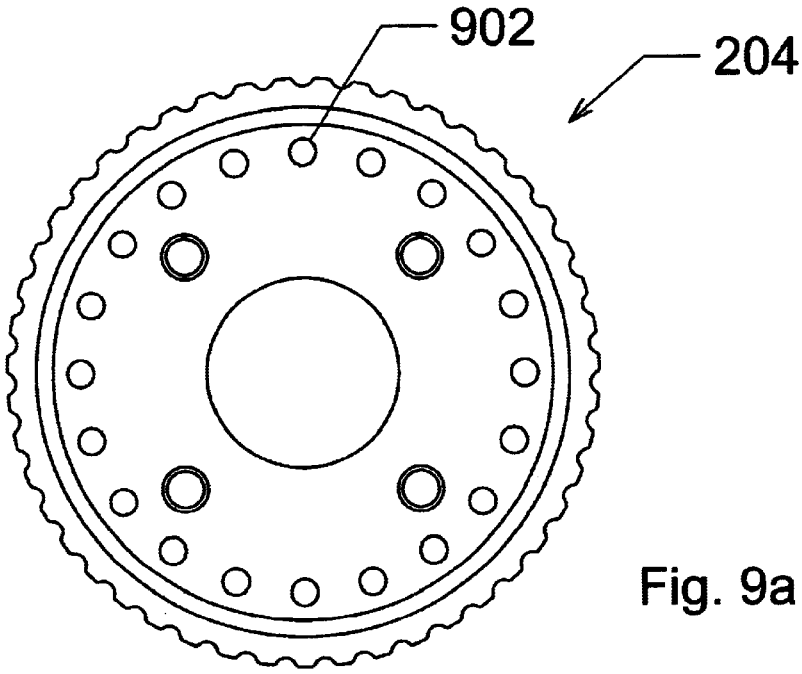
Figure 9B:
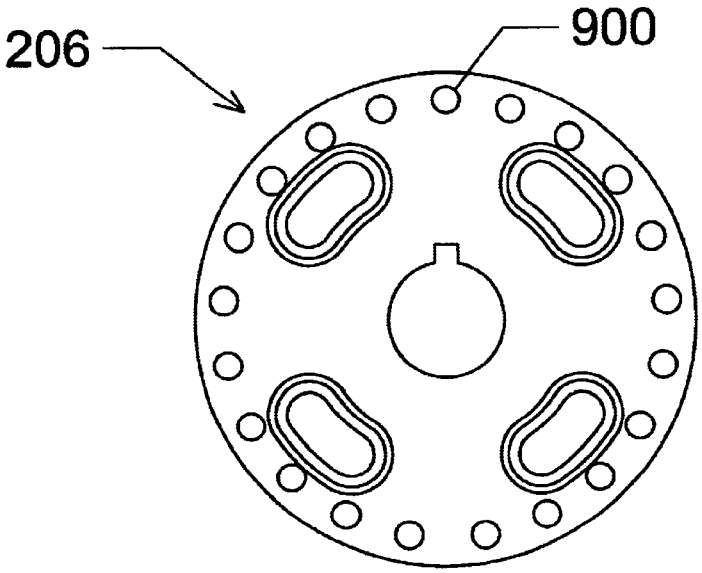

The smallest amount of adjustment that can be achieved is generally related to the relative offset between openings 208 and 404 located on their respective members and the number of openings formed in outer member 204 with respect to inner member 206. FIGS. 9*a* and 9*b* illustrates this concept.

In FIG. 9*a*, outer member 204 is shown, having 20 openings spaced equally apart near the perimeter of planar surface 510. Thus, each opening 404 is 360/20 or 18 degrees apart from one another. FIG. 9*b* shows inner member 206, having 21 openings. The number of openings on inner member 206 and their location dictate the number of discrete adjustments, and the amount of angular adjustment, the members may have with one another. In the embodiment shown in FIGS. 9*a* and 9*b*, a total of 21 possible angular relationships between members is possible, that is, there may be zero degrees, and plus or minus 10 degrees of angular adjustment, in one degree increments, between members. The location of the openings in inner member 206 is calculated as follows.

In FIG. 9*b*, a reference opening 900 is used as a reference point and references zero degrees when aligned with outer member 204. Thus, in the "zero degree" position, reference opening 900 of inner member aligns with opening 902 of outer member 204. To determine the number of openings in inner member 206, the total amount of adjustment desired in one direction is divided by the incremental adjustment desired. Thus, in this embodiment, the total amount of adjustment desired in either direction is 10 degrees and the desired incremental adjustment is 1 degree. 10 divided by 1 is equal to 10, therefore 10 openings are needed in a clockwise direction from reference opening 900, and 10 openings are needed in a counter-clockwise direction from reference opening 900.

The placement of the openings in inner member 206 with respect to reference opening 900 are calculated by the following formula:

$$\frac{(360 \text{ degrees} - \text{total adjustment desired in both directions})}{(\text{total \# of openings} - 1)} = \text{degrees between openings}$$

In this embodiment then, the distance between openings on inner member 206 is 17.0 degrees ((360−20)/(20−1)). The openings are formed on inner member 206 in both the clockwise and the counter-clockwise direction and are 17.0 degrees apart from each other beginning at reference opening 900.

In should be understood that, in another embodiment, the openings on inner member 206 may be spaced equally from each other and the openings on outer member 204 may be spaced in accordance with the above formula.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. An adjustable cam shaft sprocket, comprising:

a shear pin;

a first circular member having a toothed outer surface for receiving a timing chain, a first cam shaft opening, and a recessed planar surface having a first number of openings located proximate to a perimeter of said recessed planar surface; and a second circular member having a second planar surface and a cylindrical portion extending perpendicularly from said second planar surface, said second planar surface having a cam shaft opening extending through said cylindrical portion and a second number of openings located proximate to a perimeter of said second planar surface comprising a reference opening, openings located in clockwise proximity to said reference opening, and openings located in counter-clockwise proximity to said reference opening, said reference opening representing zero degrees of adjustment, said clockwise reference openings representing negative increments of adjustment, and said counter-clockwise openings representing positive increments of adjustment, said second circular member for being placed concentrically within said first circular member wherein said second circular member is prevented from rotating with respect to said first circular member by inserting said shear pin through one of said second number of openings and through one of said first number of openings; wherein said second circular member may be adjusted clockwise or counter-clockwise to achieve a positive or a negative adjustment to a cam timing angle by removing said shear pin and rotating said second circular member with respect to said first circular member such that a second one of said second number of openings is aligned with a second one of said first number of openings.

2. The adjustable cam shaft sprocket of claim 1, further comprising:

at least one fastener for securing said first circular member to said second circular member;

a first fastening opening located on said recessed planar surface;

a second fastening opening located on said second planar surface; wherein at least a portion of said first fastening opening is aligned with at least a portion of said second fastening opening for any possible alignment of said first circular member with respect to said second circular member, such that said at least one fastener may be inserted through said first and second fastening openings.

3. The adjustable cam shaft sprocket of claim 1, further comprising a fastener for securing said first circular member to said second circular member.

4. The adjustable cam sprocket of claim 1 wherein each of said first number of openings are spaced equally between each other; and each of said second number of openings are spaced apart from each other, beginning at a reference opening, in accordance with the following formula:

$$\frac{(360 \text{ degrees} - \text{total adjustment desired in both directions})}{(\text{total \# of openings} - 1)}.$$

5. The adjustable cam sprocket of claim 1 wherein said first number of openings comprises 20 openings and said second number of openings comprises 21 openings; wherein only one of said first number of openings is aligned with any one of said second openings at any time.

6. The adjustable cam sprocket of claim 1 wherein said first number of openings comprises one less opening than the number of said second number of openings; wherein only one of said first number of openings is aligned with any one of said second openings at any time.

7. The adjustable cam sprocket of claim 1, wherein an inner surface of each of said first number of openings comprises threads for fastening said shear pin within one of said first of openings.

8. An adjustable cam shaft sprocket, comprising:

shear prevention means;

a first circular member having a toothed outer surface for receiving a timing chain, a first cam shaft opening, and a recessed planar surface having a first number of openings located proximate to a perimeter of said recessed planar surface; and a second circular member having a second planar surface and a cylindrical portion extending perpendicularly from said second planar surface, said second planar surface having a cam shaft opening extending through said cylindrical portion and a second number of openings located proximate to a perimeter of said second planar surface comprising a reference opening, openings located in clockwise proximity to said reference opening, and openings located in counter-clockwise proximity to said reference opening, said reference opening representing zero degrees of adjustment, said clockwise reference openings representing negative increments of adjustment, and said counter-clockwise openings representing positive increments of adjustment, said second circular member for being placed concentrically within said first circular member wherein said second circular member is prevented from rotating with respect to said first circular member by inserting said shear prevention means through one of said second number of openings and through one of said first number of openings; wherein said second circular member may be adjusted clockwise or counter-clockwise to achieve a positive or a negative adjustment to a cam timing angle by removing said shear prevention means and rotating said second circular member with respect to said first circular member such that a second one of said second number of openings is aligned with a second one of said first number of openings.

9. The adjustable cam shaft sprocket of claim 8, further comprising:

at least one fastener for securing said first circular member to said second circular member;

a first fastening opening located on said recessed planar surface;

a second fastening opening located on said second planar surface; wherein at least a portion of said first fastening opening is aligned with at least a portion of said second fastening opening for any possible alignment of said first circular member with respect to said second circular member, such that said at least one fastener may be inserted through said first second fastening openings.

10. The adjustable cam sprocket of claim 8 wherein each of said first number of openings are spaced equally between each other; and each of said second number of openings are spaced apart from each other, beginning at a reference opening, in accordance with the following formula:

$$\frac{(360 \text{ degrees} - \text{total adjustment desired in both directions})}{(\text{total \# of openings} - 1)}.$$

11. The adjustable cam sprocket of claim 8 wherein said first number of openings comprises 20 openings and said second number of openings comprises 21 openings; wherein only one of said first number of openings is aligned with any one of said second openings at any time.

12. The adjustable cam sprocket of claim 8 wherein said first number of openings comprises one less opening than the number of said second number of openings; wherein only one of said first number of openings is aligned with any one of said second openings at anytime.

13. The adjustable cam sprocket of claim 8, wherein said first number of openings comprise a threaded insert for fastening said shear prevention means within one of said first number of openings.

14. The adjustable cam sprocket of claim 8, wherein an inner surface of each of said first number of openings comprises threads for fastening said shear pin within one of said first number of openings.

15. The adjustable cam shaft sprocket of claim 8, further comprising a fastener for securing said first circular member to said second circular member.

16. The adjustable cam sprocket of claim 17, wherein said fastener comprises a spring washer.

* * * * *